US011667437B2

(12) United States Patent
Altenburg et al.

(10) Patent No.: US 11,667,437 B2
(45) Date of Patent: Jun. 6, 2023

(54) MODELING CLAY CONTAINER

(71) Applicants: Kysten Altenburg, Oak Lawn, IL (US); Kyle Altenburg, Oak Lawn, IL (US)

(72) Inventors: Kysten Altenburg, Oak Lawn, IL (US); Kyle Altenburg, Oak Lawn, IL (US)

( * ) Notice: Subject to any disclaimer, the term of this patent is extended or adjusted under 35 U.S.C. 154(b) by 0 days.

(21) Appl. No.: 16/638,336

(22) PCT Filed: Sep. 5, 2018

(86) PCT No.: PCT/US2018/049597
§ 371 (c)(1),
(2) Date: Feb. 11, 2020

(87) PCT Pub. No.: WO2019/050979
PCT Pub. Date: Mar. 14, 2019

(65) Prior Publication Data

US 2020/0223591 A1 Jul. 16, 2020

Related U.S. Application Data

(60) Provisional application No. 62/555,838, filed on Sep. 8, 2017.

(51) Int. Cl.
*B65D 25/16* (2006.01)
*B65D 85/72* (2006.01)
(Continued)

(52) U.S. Cl.
CPC ..... *B65D 25/16* (2013.01); *B65D 85/72* (2013.01); *B65D 65/38* (2013.01); *B65D 77/06* (2013.01);
(Continued)

(58) Field of Classification Search
CPC ..... B65D 25/16; B65D 85/72; B65D 65/38; B65D 77/06; B65D 2231/005;
(Continued)

(56) References Cited

U.S. PATENT DOCUMENTS 2,319,384 A * 5/1943 Callan ..... D06F 95/004 232/1 B
2,793,778 A * 5/1957 Maxwell ..... A61J 9/001 215/11.1
(Continued)

FOREIGN PATENT DOCUMENTS

DE 19605705 A1 * 4/1997 ..... B44D 3/12
DE 10149841 A1 * 4/2003 ..... B65F 1/06
(Continued)

*Primary Examiner* — J. Gregory Pickett
*Assistant Examiner* — Abigail Elizabeth Guidry
(74) *Attorney, Agent, or Firm* — Skokos Law Group, LLC; Soula Skokos

(57) ABSTRACT

The container of the present invention is designed to allow for easy extraction of contents that would normally adhere to the interior walls of current containers by providing a semi rigid cylindrical container having a single continuous side defining cylindrical shape, a top portion wherein at least one flexible liner is attached to the top portion of the container. The container further possesses a bottom portion wherein such bottom portion has at least one aperture.

10 Claims, 3 Drawing Sheets

(51) Int. Cl.
*B65D 65/38* (2006.01)
*B65D 77/06* (2006.01)

(52) U.S. Cl.
CPC ..... *B65D 2231/005* (2013.01); *B65D 2543/00296* (2013.01)

(58) Field of Classification Search
CPC ..... B65D 2543/00296; B65D 2543/00027; B65D 2543/00064; B65D 2543/00648; B65D 2543/00657; B65D 2543/00759; B65D 2543/00768; B65D 2543/00842; B65D 2543/0087; B65D 88/1606; B65D 88/1612; B65D 88/1618; B65F 1/06; B65F 1/062; B65F 1/065; B65F 1/067; B65F 1/068; Y10S 220/9081
See application file for complete search history.

(56) References Cited

U.S. PATENT DOCUMENTS 2,804,995 A * 9/1957 Fee ..... B65D 83/0055 222/183
2,846,103 A * 8/1958 Maxwell ..... A61J 9/001 215/11.3
2,907,485 A * 10/1959 Lunden ..... A61J 9/001 215/11.1
2,944,705 A * 7/1960 Strumor ..... B65D 35/38 222/94
3,223,289 A * 12/1965 Bouet ..... A61M 3/00 222/209
3,262,605 A * 7/1966 Madden ..... B65D 35/28 222/103
3,545,644 A * 12/1970 Hiro ..... D06F 95/002 220/630
3,768,683 A * 10/1973 Van Den Bosch ..... A61J 9/04 215/11.5
3,777,925 A * 12/1973 Eckholm ..... A61J 9/001 215/11.3
3,986,641 A * 10/1976 Casey ..... B65D 83/62 222/95
3,995,772 A * 12/1976 Liautaud ..... B05B 11/048 222/83.5
4,062,475 A * 12/1977 Harris ..... B65D 83/32 222/95
4,098,434 A * 7/1978 Uhlig ..... B65D 83/0055 222/105
4,215,785 A * 8/1980 Schwaiger ..... A61J 9/003 215/11.6
4,241,768 A * 12/1980 Keller ..... A61J 9/001 141/313
4,459,793 A * 7/1984 Zenger ..... B65D 25/18 220/495.04
4,469,250 A * 9/1984 Evezich ..... B65D 83/0055 222/83.5
4,657,151 A * 4/1987 Cabernoch ..... A61J 9/001 215/11.6
4,821,896 A * 4/1989 Cheng ..... A61J 9/001 215/11.3
5,318,204 A * 6/1994 Davis ..... B65D 83/0055 222/105
5,332,121 A * 7/1994 Schmidt ..... B29C 45/1646 222/105
5,509,549 A * 4/1996 Marandola ..... A61J 9/001 215/11.1
5,529,794 A * 6/1996 Fultz ..... A23G 9/48 426/115
5,588,548 A * 12/1996 Brankley ..... A61J 9/00 215/11.1
5,699,920 A * 12/1997 Ida ..... A61J 9/04 215/11.5
6,042,850 A * 3/2000 Ida ..... A61J 9/001 215/11.1
6,419,129 B1 * 7/2002 Abplanalp ..... B29C 51/04 222/386.5
6,465,024 B1 * 10/2002 Di Scala ..... A61J 9/001 215/11.1
6,679,398 B1 * 1/2004 O'Brien ..... B44D 3/12 220/495.02
6,737,091 B1 * 5/2004 Littell, II ..... A61J 9/001 215/11.1
6,820,824 B1 * 11/2004 Joseph ..... B05B 7/2408 239/346
7,160,268 B2 * 1/2007 Darnell ..... A61M 3/0212 604/141
7,810,744 B2 * 10/2010 Schmon ..... B05B 7/2478 239/321
9,033,176 B2 * 5/2015 Liistro ..... B65F 1/002 220/495.06
9,815,076 B2 * 11/2017 Schulz ..... B05B 7/2478
2001/0040173 A1 * 11/2001 Yamamoto ..... A45D 19/02 222/106
2003/0024895 A1 * 2/2003 Meyers ..... A61J 9/001 215/11.5
2003/0178445 A1 * 9/2003 Safian ..... B65D 1/32 222/212
2005/0040128 A1 * 2/2005 Kong ..... A61J 11/008 215/11.3
2006/0024492 A1 * 2/2006 Walz ..... B65D 25/16 428/325
2006/0060552 A1 * 3/2006 Kasprzak ..... A61J 9/005 215/11.1
2006/0065132 A1 * 3/2006 Jongen ..... B65D 83/0055 99/485
2006/0213914 A1 * 9/2006 Victor ..... B65F 1/06 220/495.06
2006/0226171 A1 * 10/2006 Sternberg ..... B65D 83/0055 222/95
2009/0224002 A1 * 9/2009 Bakhos ..... B65D 81/245 222/209
2009/0317022 A1 * 12/2009 MacKay ..... B65F 1/0006 383/71
2010/0028512 A1 * 2/2010 Kriegel ..... C08G 63/183 426/397
2010/0204669 A1 * 8/2010 Knight ..... A61J 1/1418 604/403
2011/0151069 A1 * 6/2011 Harding ..... A61J 11/0095 426/117
2012/0111894 A1 * 5/2012 Bakhos ..... B65D 35/28 222/209
2012/0312820 A1 * 12/2012 Cadiente ..... B65D 51/1611 220/367.1
2013/0062302 A1 * 3/2013 Otero ..... B65D 23/001 215/12.1
2014/0263346 A1 * 9/2014 Bowen ..... A61B 50/36 220/495.04
2015/0024085 A1 * 1/2015 McBean ..... A61J 9/005 426/2
2015/0253067 A1 * 9/2015 Bucceri ..... A23G 9/045 62/66
2015/0359379 A1 * 12/2015 Peterson ..... B67D 3/0067 53/469
2016/0340106 A1 * 11/2016 Yamada ..... B65D 83/0055
2019/0168950 A1 * 6/2019 Gabriel ..... B65D 83/0055
2020/0180817 A1 * 6/2020 Varrichione ..... B65D 25/16
2020/0237125 A1 * 7/2020 Brown, II ..... B65D 15/10
2020/0239221 A1 * 7/2020 VanMeter ..... B65D 75/326
2020/0361660 A1 * 11/2020 Aki ..... B65B 69/0008
2021/0237944 A1 * 8/2021 Wang ..... B65D 43/022
2021/0323715 A1 * 10/2021 Woo ..... B31C 7/02

FOREIGN PATENT DOCUMENTS

GB 2442221 A * 4/2008 ..... B65F 1/1415
WO WO-2018093062 A2 * 5/2018 ..... B65D 3/06
WO WO-2019050979 A1 * 3/2019 ..... B65D 77/30
WO WO-2019118335 A1 * 6/2019 ..... A61J 11/04

* cited by examiner

MODELING CLAY CONTAINER

FIELD OF THE INVENTION

The present invention relates to a novel container that allows the user to easily remove and store solids, semi-solids and liquids.

TECHNICAL FIELD OF THE INVENTION

The present invention relates to the field of container for solid, semi solid and liquid contents allow the user to easily remove and store modeling clay.

BACKGROUND

There are a multitude of containers for various substances that range greatly both in size and materials. The type and size of container needed depends primarily on what the container is expected to hold. For containers destined to hold primarily liquids, the most effective containers do not have any perforations or openings in the container other than a lid or pouring aperture to empty the contents of the container.

For containers, however, that need to hold semi solid materials, emptying the contents of a container may prove to be more difficult. One example of such semi solid materials is modeling clay. Current modeling clay or modeling compound containers for children consist of semi rigid plastic cylindrical containers with an enclosed bottom and a flexible top that is removed of to access the contents of the container. The significant disadvantage of current containers for modeling clay is that the modeling clay or compound adheres to the interior walls of the container making it quite difficult for children to remove the modeling clay or compound from the container. Modeling compounds, due to their texture, is very difficult to remove from a plastic container because the compound sticks to the interior walls of the small container. This task is especially challenging for children.

Another possible need of a novel container is for contents that are semi solid such as foods containing gelatin that may not easily be removed from the container without sticking to the walls of the container.

The present invention overcomes such disadvantages by providing a container that allows the contents of the container to be easily removed from the container by users, even children. The container of the present invention is designed to allow for easy extraction of contents that would normally adhere to the interior walls of current containers.

DETAILED DESCRIPTION OF THE DRAWINGS

Figure 1:
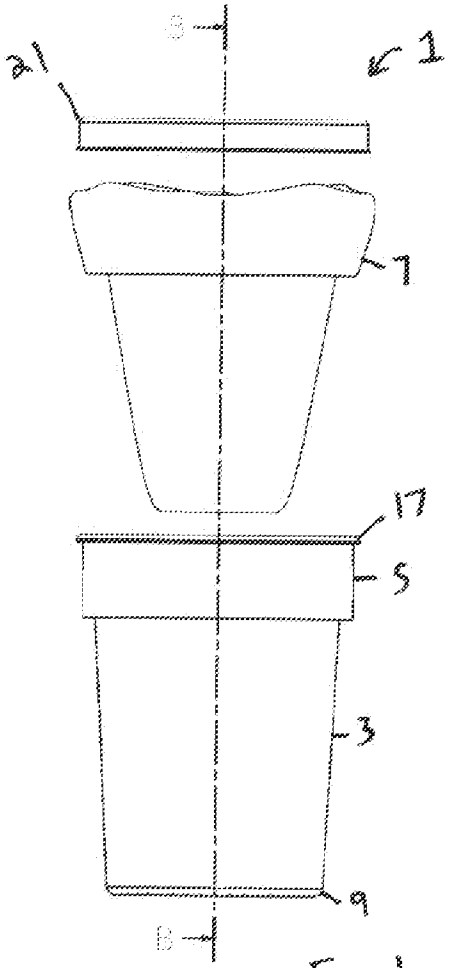
FIG. 1 illustrates a front exploded view of the present invention.
Figure 4:
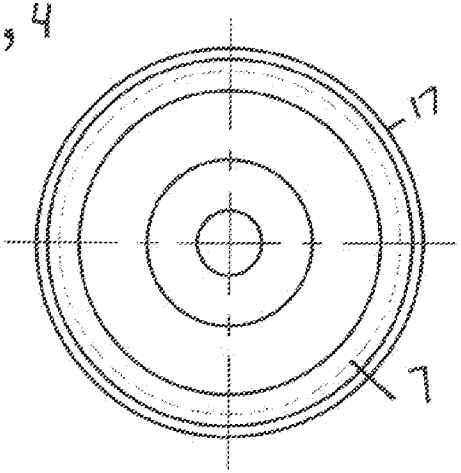
FIG. 4 illustrates a top view of the present invention wherein the flexible liner of the present invention is shown in broken lines.
Figure 5:
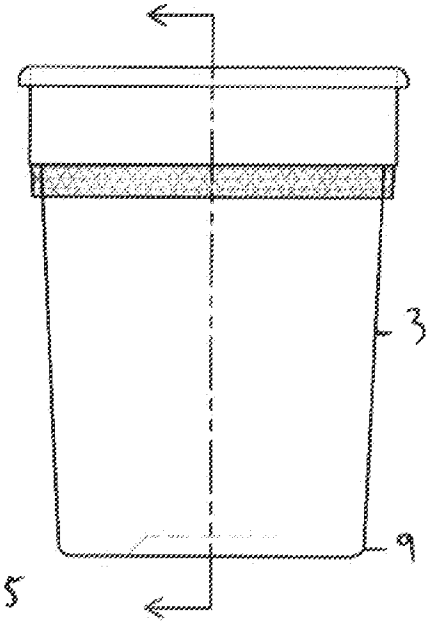
FIG. 5 illustrates a front view of the present invention wherein the interior details of the bottom of the container is shown in broken lines.

As shown in FIG. 1, the present invention is comprised of a semi rigid cylindrical container generally shown at 1, having a single continuous side 3 that defines the cylindrical shape, a top portion 5 wherein at least one flexible liner 7 is attached to the top portion 5 of the container and a bottom portion wherein such bottom portion 9 has at least one aperture 11 (not shown).

The flexible liner of the present invention may be constructed of any flexible material including but not limited to a low-density polyethylene plastic. The liner may be constructed of a man-made synthetic or natural material, transparent or opaque. In one embodiment, the liner may be washable material such that the liner may be cleaned after repeated uses. In another embodiment, the liner may be constructed of plant-based bio-polyethylene terephthalate.

The liner's proportions and shape are configured to fit the dimensions of the cylindrical container. The liner is shaped to fit the shape of the container but is slightly smaller in size to be easily nested within the container and easily removable from the container.

Figure 6:
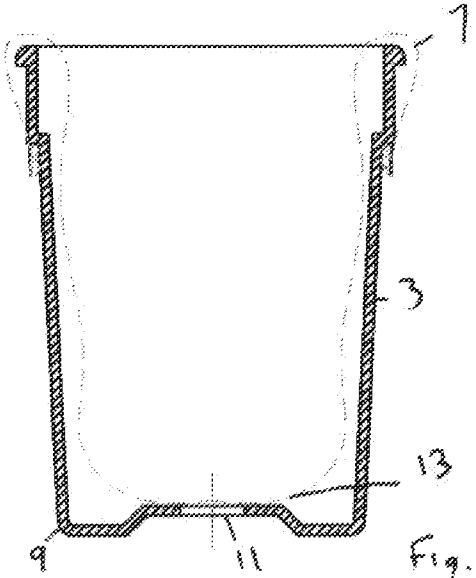
FIG. 6 illustrates a front cross-sectional view of the present invention wherein the flexible liner of the present invention is shown in broken lines.

While FIG. 6 illustrates that the flexible liner 7 may line the interior of the container such that there is no space between the bottom portion 9 of the container and the bottom 13 of the flexible liner, the flexible liner 7 may be sized to allow for space between the bottom portion of the interior of the container and the bottom of the flexible liner. In a preferred embodiment, the flexible liner 7 may range in length from extending to the bottom of the container allowing no space between the bottom of the flexible liner and the bottom of the container to extending to about 50% of the height of the interior of the container.

As shown in FIGS. 1, 2, 3, 5 and 6, the flexible liner is attached to the top portion 5 of the container wherein the edge 15 of the liner is adhered to the top portion 5 of the container. Further, as shown in FIGS. 1, 2, 3, 5 and 6, the top portion may be raised and consequently wider in diameter relative to the body of the container. In one embodiment of the present invention, the top portion 5 of the container may have a lip or edge 17. In such embodiment, the edge of the liner 15 is adhered to the outer surface of the container below or near such lip or edge 17. The flexible liner 7 is adhered to the container via an adhesive to the exterior surface of the container below the lip or edge 17. The adhesive may be any adhesive compound, resin or other means of adhering the liner to the container including but not limited to a cyanoacrylate adhesive. In another embodiment, the edge of the liner may be attached to the interior surface of the top portion of the container.

In one embodiment, the flexible liner 7 may be removable. The flexible liner 7 may be fastened to the exterior of the container via fastening means. The fastening means may be any common fastening means including but not limited to hook-and-loop fasteners (e.g. Velcro®), adhesive, and elastic band. In one embodiment, the fastening means may include an integrated elastic edge to the liner so that such elastic edge may grab the outer surface of the top portion of the container.

Figure 7:
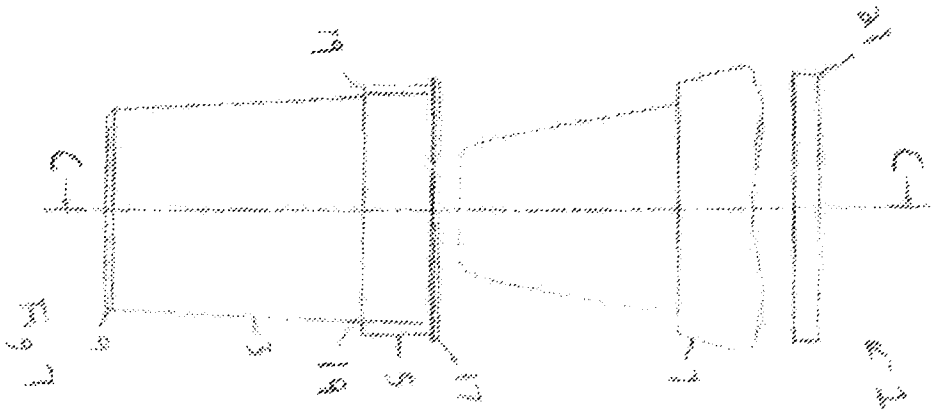
FIG. 7 illustrates a front cross-sectional view of the present invention wherein the flexible liner of the present invention is shown in broken lines.

As shown in FIG. 7, in one embodiment, the top portion 5 and/or lip 17 of the container may possess a channel 19 extending the circumference of the side wall of the container. In such embodiment, the edge 15 of the flexible liner may fit within and secured to the top portion 5 of the container.

Figure 3:
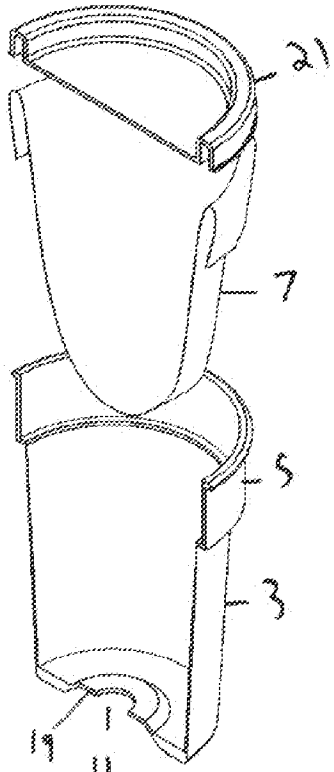
FIG. 3 illustrates a perspective cross-sectional view of the present invention.
Figure 2:
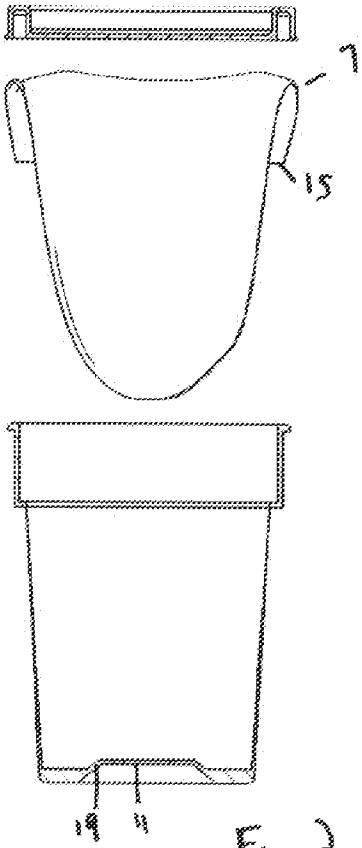
FIG. 2 illustrates a front cross-sectional view of the present invention.

The bottom portion 9 of the container has at least one aperture 11. The purpose of the at least one aperture 11 is to eliminate the suction within the container between the flexible liner and the side wall of the container 3. The at least one aperture 11 may be located in the center of the bottom portion 9 of the container. In another embodiment, the at least one aperture may be located at any position in the bottom portion of the container. The at least one aperture 11 may be of any size and shape and not is limited to the shape and size as shown in the Figures. In one embodiment, as shown in FIGS. 2 and 3, the bottom wall of the container encircling the at least one aperture 11 may be beveled.

When a substance such as a modeling compound or semi solid material is placed into the container and specifically within the liner of the container, such compound can easily be removed by simply turning the container over to empty the contents of the container. The material of the liner as well as its flexibility prevent contents from adhering to the liner. By turning over the container, the contents of the container simply fall out of the container.

The container may further include a removable plastic lid 21. The plastic lid 21 provides a closure to the container to allow the contents of the container to be secure. In the case of modeling clay or modeling compound, such lid would also prevent the modeling clay or compound from drying out. In one embodiment, the plastic lid 21 may have a tab, pull tab, pull or other conventional means to easily remove the plastic lid 21.

The container of the present invention may be of any size, proportion and shape and not is limited to the cylindrical container described herein. In a preferred embodiment, the height of the container may range from 1 inch to 3.25 inches. In a preferred embodiment, the diameter of the container may range between 1.5 inches and 2.75 inches.

The container may further be constructed of any rigid or semi rigid material, including but not limited to plastic, metal, wood or wood composite. In one embodiment, the container is constructed of plant-based bio-polyethylene terephthalate.

The foregoing detailed description is given for clearness of understanding only, and no unnecessary limitations should be understood therefrom, as modifications will be obvious to those skilled in the art.

The invention is claimed as follows:

1. A container allowing for the ease of removal of its contents comprised of a container having a single continuous side defining a frustoconical shape, a bottom portion ending in a flat bottom at one end of the container having one aperture providing a pathway to the exterior, a top portion at the opposite end having an opening at least wide as wide as the continuous side providing an edge, wherein the cross section of the container gradually increases from the bottom portion to the top portion and aperture, a non rigid flexible liner wherein the at least one flexible liner is attached with the use of adhesive to the exterior of the single continuous wall in the top portion of the container below the edge.

2. A container according to claim 1 wherein the at least one flexible liner is attached to the interior of the top portion of the container.

3. A container according to claim 1 wherein the top portion possesses a channel.

4. A container according to claim 3 wherein the at least one flexible liner is secured to the channel of the top portion of the container.

5. A container according to claim 1 wherein the at least one flexible liner is sized and shaped to fit and nest within the container.

6. A container according to claim 1 wherein the at least one aperture is located in the center of the bottom portion of the container.

7. A container according to claim 1 wherein the container possesses a lid.

8. A container according to claim 1 wherein the container is constructed of a semi rigid material.

9. A container according to claim 1 wherein the container is constructed of plant-based bio-poly ethylene terephthalate.

10. A container allowing for the ease of removal of its contents comprised of a container having a single continuous side defining a frustoconical shape, a bottom portion ending in a flat bottom at one end of the container having one aperture providing an pathway to the exterior, a top portion at the opposite end having an opening at least wide as wide as the continuous side, wherein the cross section of the container gradually increases from the bottom portion to the top portion and aperture, a non rigid flexible liner wherein the at least one flexible liner is attached to the exterior of the single continuous wall in the top portion of the container below the edge via attachment means.

* * * * *